United States Patent [19]

Barcelo

[11] Patent Number: 4,999,847

[45] Date of Patent: Mar. 19, 1991

[54] SHIN GUARD

[75] Inventor: Nathalie Barcelo, Montreal, Canada

[73] Assignee: sport Maska Inc., St.-Hyacinthe, Canada

[21] Appl. No.: 399,880

[22] Filed: Aug. 29, 1989

[51] Int. Cl.[5] ..... A41D 13/06

[52] U.S. Cl. ..... 2/24; 2/2; 2/22

[58] Field of Search ..... 2/2, 22, 24

[56] References Cited

U.S. PATENT DOCUMENTS

| | | | |
|---|---|---|---|
| 2,325,321 | 7/1943 | Hubner et al. | 2/22 |
| 3,135,964 | 6/1964 | Pender . | |
| 3,735,419 | 5/1973 | Byrd . | |
| 4,354,280 | 10/1982 | Hayes . | |
| 4,490,855 | 1/1985 | Figgie, III et al. | 2/24 |
| 4,599,748 | 7/1986 | Garcia | 2/22 |

*Primary Examiner*—William A. Cuchlinski, Jr.
*Assistant Examiner*—Daniel G. DePumpo
*Attorney, Agent, or Firm*—Fleit, Jacobson, Cohn, Price, Holman & Stern

[57] ABSTRACT

A shin guard which provides desired characteristics of smallness of size and lightness in weight, while affording the necessary protection to the shins and knees of users when worn under their pants. The shin guard includes an elongated shin protector section which is strapped around the shin of the user and which tapers outwardly from the shin to encircle the front portion of the leg below the kneecap so as to provide protection for the user. A knee protector section is pivotably mounted to the uppermost portion of the shin protector section. At a lowermost edge of the knee protector section is an elongated flexible tongue which extends along an interior surface of the shin protector section so when there is bending of the leg at the knee, the flexible tongue extends from beyond the shin protector section and is flexed outwardly so as to provide a guard against contact with the knee of a user while providing a space for outward flexing of the upper part of the tibia of the leg between convergent extensions of the shin protector section. The tongue is sufficiently flexible to operate within a restricted area under the pant leg or stocking of a user.

19 Claims, 3 Drawing Sheets

SHIN GUARD

FIELD OF THE INVENTION

The present invention relates to a protective shin guard for use by a player needing protection in their shin and knee areas such as players or referees of hockey games or other sports.

BACKGROUND OF THE INVENTION

Articulated shin pads for hockey players are presently available which are worn under elastic socks. Therefore, the shin pads for hockey players may be of a large size and bulk since their size is compensated for by the elasticity of a covering sock.

An example of such a shin pad for a hockey player appears in Canadian Industrial Design Application Registration No. 45328. This product has a disadvantage in that an upper part of the pad extends high on the leg of the wearer and when there is significant flexing of the leg, such as bending at the knee, the shin pad does not take into account the movement forward on the outside of the leg of the upper part of the tibia bone. Therefore, this shin pad acts against the natural ergonomy of the body in movement.

For certain users such as officials or referees of hockey games, for example, or anyone desiring a small, light, flexible shin guard, a smaller and lighter shin guard is required other than that traditionally used by a hockey player. Therefore, the above-mentioned Canadian Industrial Design Application Registration would not be suitable for use by one desiring a light, flexible shin guard in that certain hockey players, preferably hockey referees, for example, traditionally wear their protective shin guards under pants which lack the elasticity of the socks used by hockey players to compensate for the bulk and amount of movement of their protective equipment. The Canadian Registration, if used by an official or referee, would engage the pants leg or stocking of the wearer and cause discomfort and reduction in freedom of movement.

An alternative which has been explored for use by officials or referees of hockey games has been to associate an elbow padding with a regular pad to produce the desired feature of having a lightweight pad. However, this attempt has been found not to provide the necessary protection for the user.

SUMMARY OF THE INVENTION

It is therefore, an object of the present invention to provide a shin guard which overcomes the disadvantages of the prior art and provides the desired characteristics of smallness of size and lightness in weight and flexibility, while affording the necessary protection to the shins and knees of a user, such as hockey referees or even to a hockey player or players of other sports, when worn under their pants or stockings.

By the present invention, a shin guard includes an elongated shin protector section which is adapted to be strapped around the shin of the user and which tapers outwardly from the shin to encircle the front portion of the leg below the kneecap so as to provide protection for the user. A knee protector section is pivotably mounted to the uppermost portion of the shin protector section.

At a lowermost edge of the knee protector section is an elongated flexible tongue which extends along an interior surface of the shin protector section. When there is bending of the leg at the knee, the flexible tongue extends from the shin protector section and is flexed outwardly so as to provide a guard against contact with the knee of a user while providing a space for outward flexing of the upper part of the tibia of the leg between convergent portions of the shin protector section. The tongue is sufficiently flexible to operate within a restricted area within the pant legs of a user.

It is also an object of the present invention to provide an improved shin and knee guard for sports players.

It is another object of the present invention to provide an improved shin and knee guard which may be worn under the pants of a user in a hockey game or other sports.

It is yet another object of the present invention to provide a shin guard having a shin protector section and a knee protector section pivotably mounted on the shin protector section so as to protect a hockey player or referee or other sports player which allow for movement of the upper part of the tibia.

It is still yet another object of the present invention to provide a shin guard having a shin protector section and a knee protector section pivotably mounted on the shin protector section so as to protect a hockey player or referee or other sports player with the knee protector section including an elongated tongue extending along an interior surface of the shin protector section and being sufficiently flexible to operate under the pants leg or stocking of a player.

It is still yet another object of the present invention to provide a shin guard having a shin protector section and a knee protector section pivotably mounted on the shin protector section so as to protect a hockey player or referee or other sports player with the knee protector section including an elongated tongue extending along an interior surface of the shin protector section and being sufficiently flexible to operate under the pants leg or stocking of a player and the tongue extending forwardly of the shin protector section when the knee protector section is moved away from the shin protector section about its pivot so as to protect the kneecap and the upper part of the tibia of the player.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
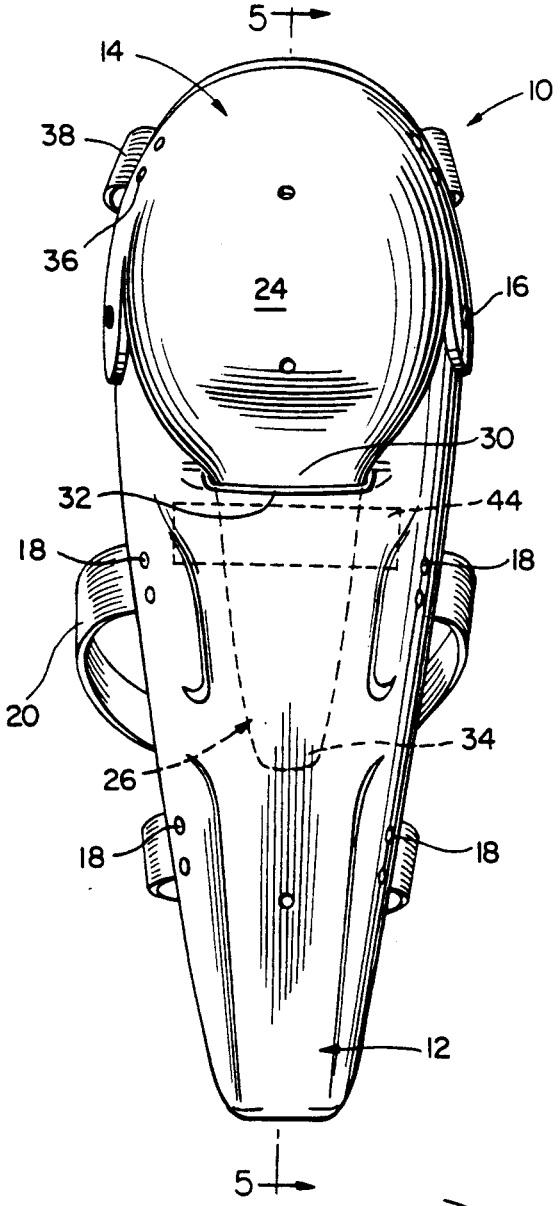
FIG. 1 illustrates a shin guard of the present invention.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 2:
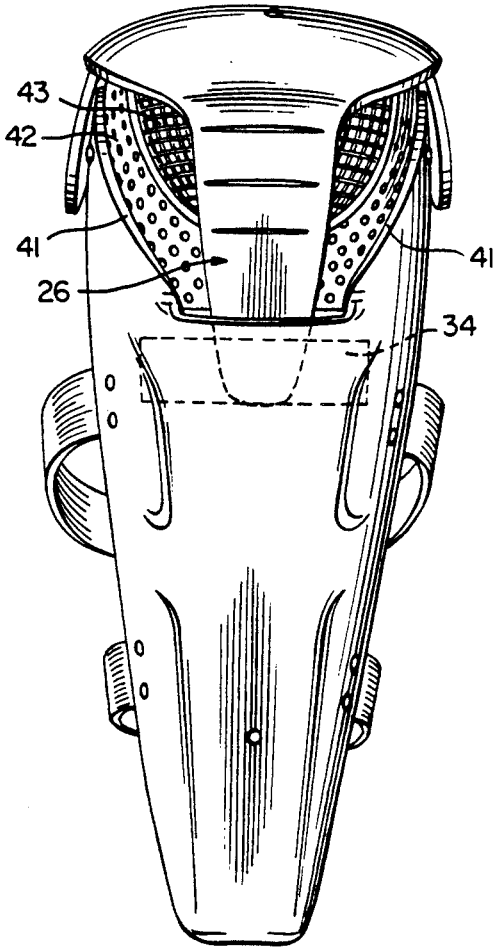
FIG. 2 illustrates pivoting of a knee protector section away from a shin protector section.
Figure 4:
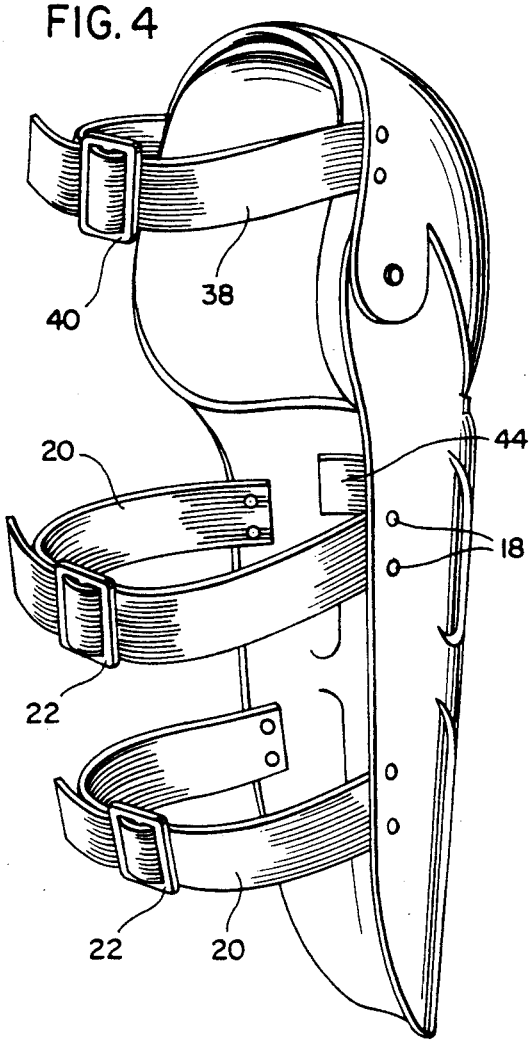
FIG. 4 is a rear perspective view of the shin guard.

With reference to the drawings, in general, and to FIGS. 1, 2 and 4, in particular, a shin guard embodying the teachings of the subject invention is generally designated as 10. With reference to its orientation in FIG. 1, the shin guard comprises a shin protector section 12 and a knee protector section 14. The knee protector section is pivotably mounted on the shin protector section 12 by two opposed rivets 16 or by any other suitable means. Both the knee protector section and shin protector section are made of a rigid plastic material. The knee protector section includes padding along an interior surface which will be described later with reference to FIG. 2.

The shin protector section 12 is adapted to be strapped onto the leg of a user, along the shin, from above the foot to below the kneecap of the user. A series of rivets 18 located along opposite edges of the shin protector section secure two leg straps 20 to the shin protector section which include a buckle 22 for securing the shin protector section about the leg of the user.

The knee protector section includes a knee cap portion 24 and an elongated flexible tongue 26 extending downwardly from a bottom edge of the kneecap section 24. The tongue 26 extends and slides along an interior surface 28 of the shin protector section 12. An upper end 30 of the tongue 26 engages with an edge 32 of the shin protector section to prevent further forward movement of the kneecap section 24 downwardly towards the shin protector section. The tongue 26 is inwardly tapered from upper end 30 towards its lower end 34.

Complementary to the tongue 26 are convergent extensions 41 of the shin protector section which extend toward the tongue and define a narrow opening over which the tongue slides and through which the upper part of the tibia projects upon bending of the leg. Further, upon bending of the leg, the knee protector section 14 is moved away from the shin protector section 12 so as to expose the tongue 26 sliding outwardly from the interior surface of the shin protector section. The tongue covers the opening located between the extensions 41 of the knee cap portion and allows outward movement of the upper part of the tibia bone.

Figure 5:
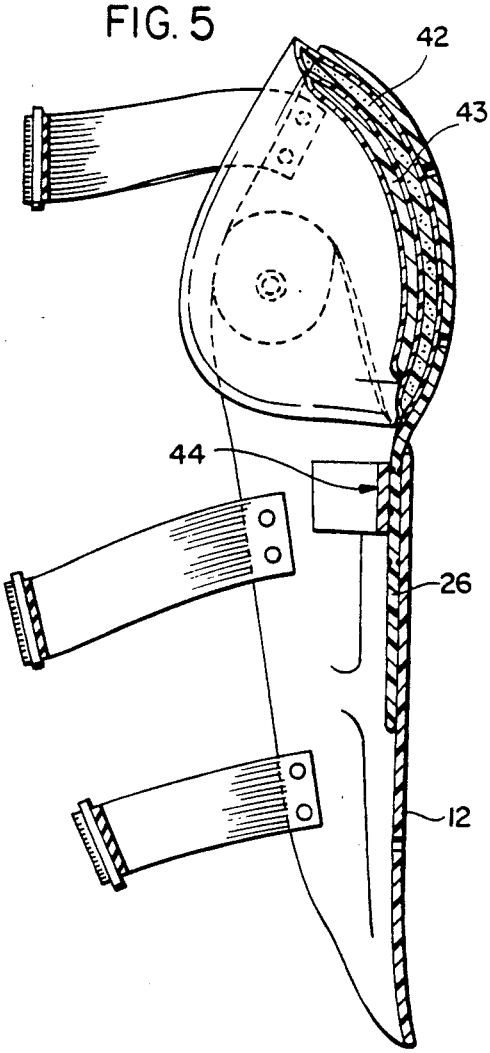
FIG. 5 is a sectional view taken along line 5—5 of FIG. 1.
Figure 6:
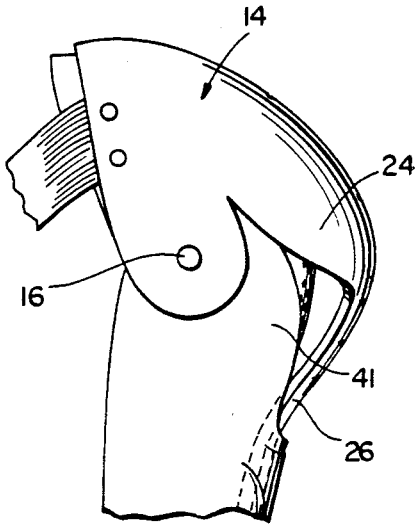
FIG. 6 is a side view showing the knee protector section flexed away from the shin protector section so as to expose the flexible tongue of the knee protector section being withdrawn from an interior surface of the shin protector section and extending forwardly of the shin protector section over the upper part of the tibia bone.
Figure 7:
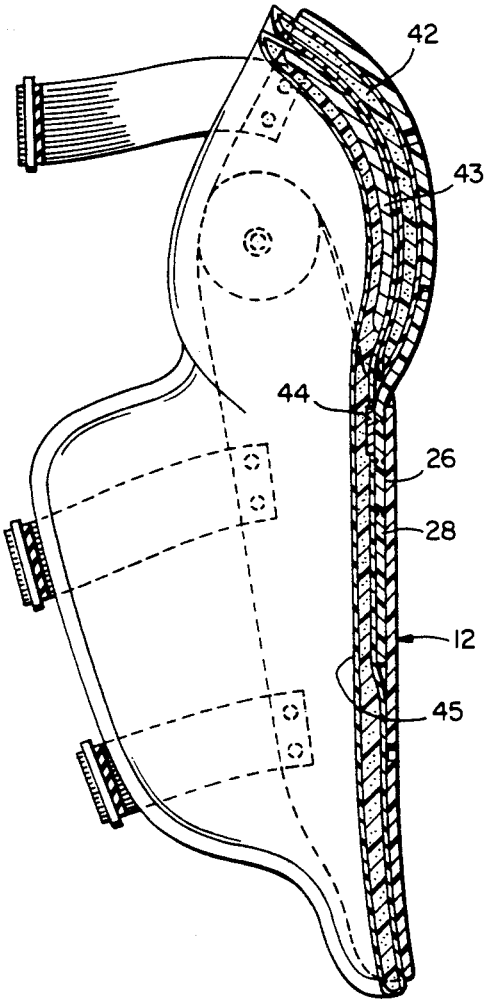
FIGS. 7 and 8 are sectional views of alternate embodiments of the invention taken along line 5—5 of FIG. 1.
Figure 8:
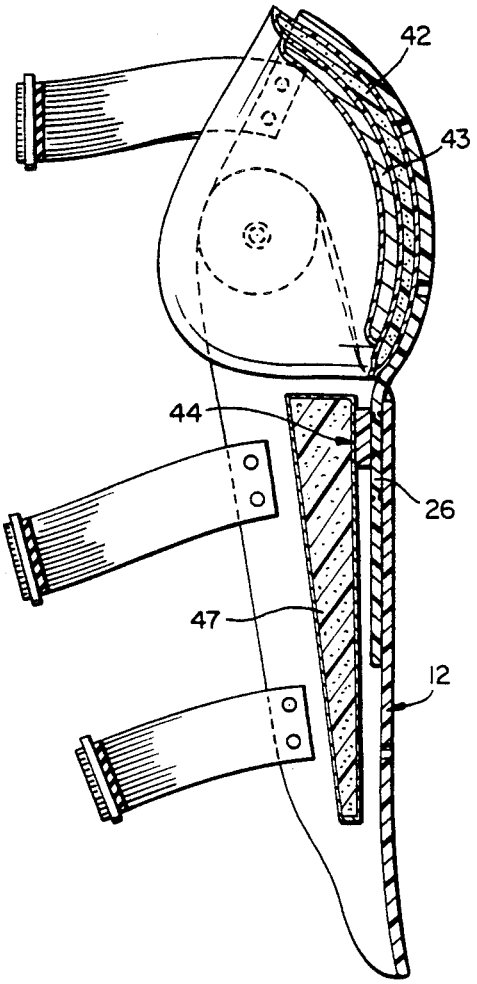

As shown in FIGS. 5, 7 and 8, the tongue 26 extends and slides along the interior surface 28 of the shin protector section 12. As the tongue slides outwardly from the shin protector section, the flexibility of the tongue and the position of the upper portion 30 of the tongue integral with the kneecap section 24 causes the tongue 26 to flex slightly outward away from the kneecap of the user as shown in FIG. 6. This allows for the forward movement under the tongue 26 of the upper part of the tibia bone on the outside of the leg as the knee is bent. By this movement of the tongue 26, the tibia of the user is protected by the extensions 41 and the tongue 26 and the kneecap and shin remain protected by the kneecap portion of the knee protector and the shin protector section, respectively.

Figure 3:
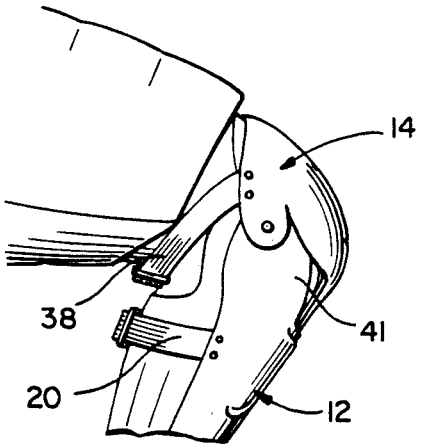
FIG. 3 shows the shin guard strapped to the leg of a user with the user's pant leg being cut away for illustrative purposes.

Similar to the shin protector section, the knee protector section includes rivets 36 which secure strap 38 to the knee protector section. The strap 38 is secured around the upper leg of the user by buckle 40 as shown in FIGS. 3 and 4.

In addition to the protection afforded by the shin protector section and knee protector section, protective padding 42 is secured within the interior of the kneecap portion 24. Additionally, a strap 44 extends in the interior of the shin protector section between opposed side edges of the shin protector section and slightly above and between the opposed sets of upper securing rivets 18. The rigid plastic longitudinal strap 44 extends substantially straight between the upper set of securing rivets, adjacent to edge 32 at an uppermost portion of a central area of the shin protector section and defines between itself and the shin protector section, a gap for receipt of the tongue 26 as it slides as a result of movement of the kneecap portion. This is best shown in FIG. 5.

In FIG. 7, additional padding 45 extends along an interior surface of both the shin protector section and the knee protector section. The strap 44 is sandwiched between the padding 45 and the interior surface of the shin protector section.

In FIG. 8, fabric sheet 47 is used separate from or in addition to padding 45 shown in FIG. 7. Fabric sheet 47 is used to contact the shin of the player and hold the shin guard on the leg of the player.

Reinforced protective padding 43 is located within the interior of the protective padding 42. Upon flexing of the kneecap portion 24, as shown in FIG. 2, the bottom edge of protective padding 43 is seen as well as protective padding 42.

By the invention, a lightweight and compact shin guard fully protects the lower legs of a user as the protective equipment is worn underneath his pant leg of stocking. Upon bending of the leg, the tongue of the knee protector section extends from within the shin protector section so as to protect the upper part of the protruding tibia bone extending between extensions of the shin protector section while maintaining full protection of the kneecap and shin by the remaining portions of the shin guard.

Having described the invention, many modifications thereto will become apparent to those skilled in the art to which it pertains without deviation from the spirit of the invention as defined by the scope of the appended claims.

I claim:

1. A shin guard comprising:

a shin protector section, a knee protector section pivotably mounted on said shin protector section, a tongue portion extending from said knee protector section, said tongue portion extending along an interior surface of said shin protector section, and an opening defined by separated portions of said shin protector section for extension of an upper part of the tibia bone during bending of the user's knee.

2. A shin guard according to claim 1, wherein said tongue portion flexes outwardly from said shin protector section during withdrawal of said tongue portion from said shin protector section.

3. A shin guard according to claim 2, wherein said tongue portion tapers inwardly from said knee protector section.

4. A shin guard according to claim 1, wherein said knee protector section includes a kneecap portion and said tongue portion and said shin protector section includes an edge for limiting movement of an upper end of said tongue portion towards said shin protector section.

5. A shin guard according to claim 1, wherein said knee protector section and said shin protector section include means for mounting the shin guard on a leg of a wearer.

6. A shin guard according to claim 1, wherein said shin protector section includes a strap extending adjacent to an uppermost portion of a central area of said shin protector portion and between opposed side edges and said tongue portion is located between said strap and said interior surface of said shin protector section.

7. A shin guard for a sports player, said shin guard comprising:

a shin protector section, a knee protector section pivotably mounted on said shin protector section, said knee protector section including a kneecap portion and a tongue portion integral at one end with said kneecap portion and extending from said kneecap portion and extending along an interior surface of said shin protector section, and an opening defined by separated portions of said shin protector section for extension of an upper part of the tibia bone during bending of the user's knee.

8. A shin guard for a sports player according to claim 7, wherein said tongue portion flexes outwardly from said shin protector section during withdrawal of said tongue portion from said shin protector portion.

9. A shin guard for a sports player according to claim 7, wherein said shin protector section includes an edge for limiting movement of said one end of said tongue portion toward said shin protector section.

10. A shin guard for a sports player according to claim 7, wherein said knee protector section and said shin protector section include means for mounting the shin guard on a leg of a sports player.

11. A shin guard for a sports player according to claim 7, wherein said shin protector section includes a strap extending between opposed side edges and said tongue portion is located between said strap and said interior surface of said shin protector section.

12. A shin guard for a sports player according to claim 7, wherein said shin protector section includes padding along said interior surface and said tongue portion is located between said padding and said interior surface of said shin protector section.

13. A shin guard for a sports player according to claim 12, wherein said padding includes a fabric covering.

14. A shin guard comprising:

a shin protector section, a knee protector section pivotably mounted on said shin protector section, and a tongue portion extending from said knee protector section, said tongue portion extending along an interior surface of said shin protector section, said tongue portion flexing outwardly from said shin protector section during withdrawal of said tongue portion from said shin protector section.

15. A shin guard according to claim 14, wherein said tongue portion tapers inwardly from said knee protector section.

16. A shin guard comprising:

a shin protector section, a knee protector section pivotably mounted on said shin protector section, and a tongue portion extending from said knee protector section, said tongue portion extending along an interior surface of said shin protector section, said shin protector section including a strap extending adjacent to an uppermost portion of a central area of said shin protector portion and between opposed side edges and said tongue portion being located between said strap and said interior surface of said shin protector section.

17. A shin guard for a sports player, said shin guard comprising:

a shin protector section, and a knee protector section pivotably mounted on said shin protector section, said knee protector section including a kneecap portion and a tongue portion integral at one end with said kneecap portion and extending from said kneecap portion and extending along an interior surface of said shin protector section, said shin protector section including a strap extending between opposed side edges and said tongue portion being located between said strap and said interior surface of said shin protector section.

18. A shin guard for a sports player, said shin guard comprising:

a shin protector section, and a knee protector section pivotably mounted on said shin protector section, said knee protector section including a kneecap portion and a tongue portion integral at one end with said kneecap portion and extending from said kneecap portion and extending along an interior surface of said shin protector section, said shin protector section including padding along said interior surface and said tongue portion being located between said padding and said interior surface of said shin protector section.

19. A shin guard for a sports player according to claim 18, wherein said padding includes a fabric covering.

* * * * *